US009722365B1

(12) United States Patent
Wang et al.

(10) Patent No.: US 9,722,365 B1
(45) Date of Patent: Aug. 1, 2017

(54) CONNECTOR

(71) Applicant: Allsmartlite Technology Co., Ltd., Shenzhen (CN)

(72) Inventors: Xiaoping Wang, Shenzhen (CN); Ming-Han Perng, Shenzhen (CN); Chien-Hsing Lai, Shenzhen (CN)

(73) Assignee: ALLSMARTLITE TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/229,130

(22) Filed: Aug. 5, 2016

(51) Int. Cl.
*H01R 13/6594* (2011.01)
*H01R 13/6581* (2011.01)
*H01R 12/72* (2011.01)
*H01R 13/66* (2006.01)

(52) U.S. Cl.
CPC ..... *H01R 13/6594* (2013.01); *H01R 12/722* (2013.01); *H01R 13/6581* (2013.01); *H01R 13/665* (2013.01); *H01R 13/6608* (2013.01)

(58) Field of Classification Search
CPC ..... H01R 13/6594
See application file for complete search history.

(56) References Cited

U.S. PATENT DOCUMENTS 5,587,884 A * 12/1996 Raman ..... H01R 13/665 333/182
6,162,089 A * 12/2000 Costello ..... H01R 23/6873 29/832
6,174,198 B1 * 1/2001 Wu ..... H01R 13/659 439/541.5
6,902,433 B1 * 6/2005 Hashimoto ..... H01R 23/6873 439/620.15
7,037,136 B1 * 5/2006 Korsunsky ..... H01R 13/5213 174/16.1
9,490,595 B2 * 11/2016 Little ..... H01R 13/6594
2008/0207021 A1 * 8/2008 Hsu ..... H01R 13/6658 439/79
2008/0242127 A1 * 10/2008 Murr ..... H01R 13/665 439/79
2010/0003853 A1 * 1/2010 Chuang ..... H01R 12/712 439/607.22
2011/0287663 A1 * 11/2011 Gailus ..... H01R 13/6608 439/620.21
2014/0069707 A1 * 3/2014 Do ..... H01R 13/6581 174/359

(Continued)

*Primary Examiner* — James Harvey
(74) *Attorney, Agent, or Firm* — Leong C. Lei

(57) ABSTRACT

The connector includes a circuit board having a number of electronic components, a transmission assembly joined to the circuit board to a side of the electronic components, a first shielding member on the circuit board shielding the transmission assembly, a second shielding member on the circuit board shielding the electronic components, and a cover on and shielding the first and second shielding members. The connector can be produced to meet different needs by using a common first shielding member joined to a second shielding member adapted to a specific requirement such as dimension, shape, etc., thereby reducing the production and stock costs. The transmission assembly and the electronic components are shielded by the first and second shielding members, respectively, which are further shielded by the cover so as to prevent RF signal leakage and to achieve superior transmission quality.

6 Claims, 6 Drawing Sheets

(56) References Cited

U.S. PATENT DOCUMENTS

| | | | | |
|---|---|---|---|---|
| 2015/0244111 | A1* | 8/2015 | Ju | H01R 13/6585 439/607.05 |
| 2015/0263458 | A1* | 9/2015 | Guo | H01R 12/724 439/607.4 |
| 2016/0197442 | A1* | 7/2016 | Lin | H01R 13/6585 439/607.05 |
| 2016/0352041 | A1* | 12/2016 | Yao | H01R 13/405 |
| 2017/0018883 | A1* | 1/2017 | Chen | H01R 24/62 |
| 2017/0062957 | A1* | 3/2017 | Choi | H01R 12/725 |
| 2017/0085017 | A1* | 3/2017 | Chen | H01R 12/7082 |

* cited by examiner

CONNECTOR

BACKGROUND OF THE INVENTION (a) Technical Field of the Invention

The present invention is generally related to electrical connectors, and more particular to a connector of enhanced transmission quality, flexible production, and low cost.

(b) Description of the Prior Art

A conventional electrical connector includes at least a metallic case, at least a plastic insulating member inside the metallic case, a number of metallic transmission terminals on the insulating member, and a circuit board connected to the transmission terminals. The metallic case is for engaging a corresponding connector so that the communication link is established between the transmission terminals of the two connectors. However, during signal transmission, there may be radio-frequency (RF) signal leakage from the metallic terminals and the circuit boards, compromising the signal transmission quality.

SUMMARY OF THE INVENTION

Therefore the present invention provides a connector of enhanced transmission quality, flexible production, and low cost.

A major objective of the present invention is that the connector is able to reduce interference so as to enhance transmission quality.

Another major objective of the present invention is that the connector is adaptable to various requirements.

Yet another major objective of the present invention is that the connector has a low production cost.

To achieve these objectives, the connector includes a circuit board having a number of electronic components, a transmission assembly joined to the circuit board to a side of the electronic components, a first shielding member on the circuit board shielding the transmission assembly, a second shielding member on the circuit board shielding the electronic components, and a cover on and shielding the first and second shielding members. The connector can be produced by using a common first shielding member joined to a second shielding member adapted to a specific requirement such as dimension, shape, etc. Having separate first and second shielding members to meet different needs contributes to the connector's production flexibility and lowers production and stock costs.

When the connector is used for communications, the set of transmission terminals and the electronic components may produce RF signals. Yet, the transmission assembly is shielded by the first shielding member, the electronic components are shielded by the second shielding member, and the first and second shielding members 31 are further shielded by the cover. Therefore, the RF signals are prevented from leakage, and transmission quality is enhanced.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
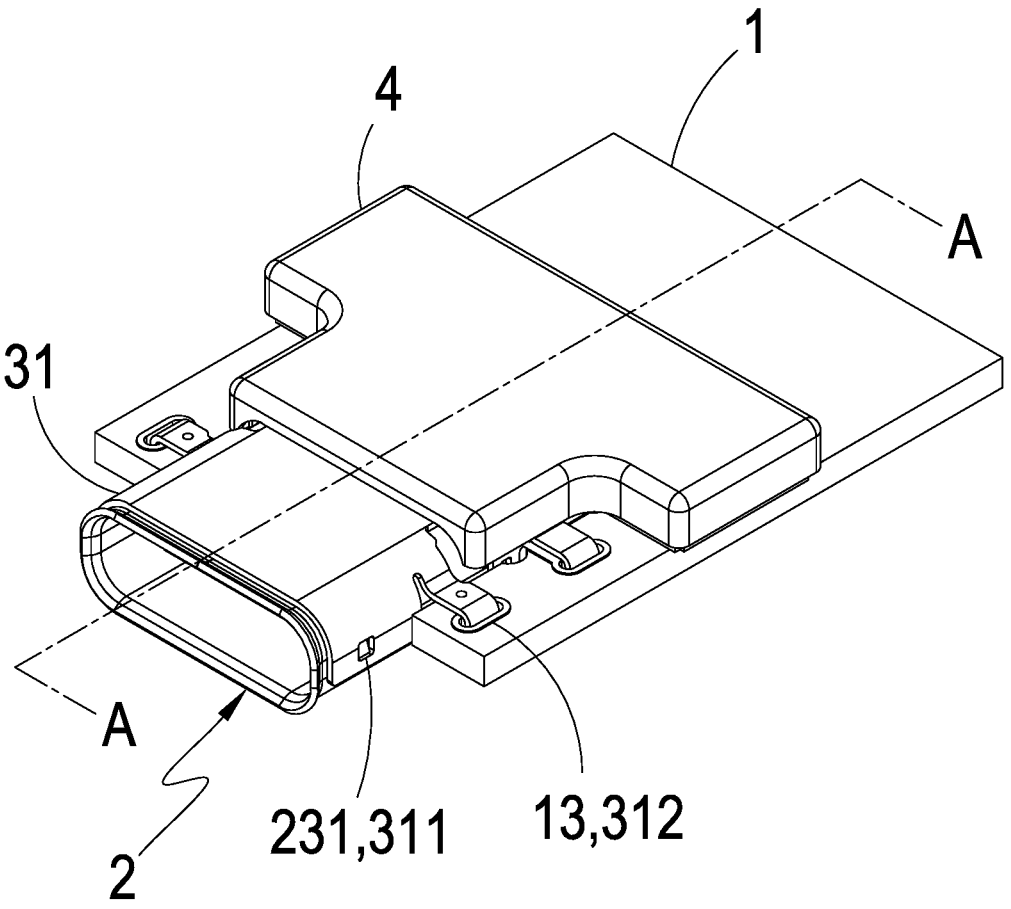
FIG. 1 is a perspective diagram showing a connector according to a first embodiment of the present invention.
Figure 2:
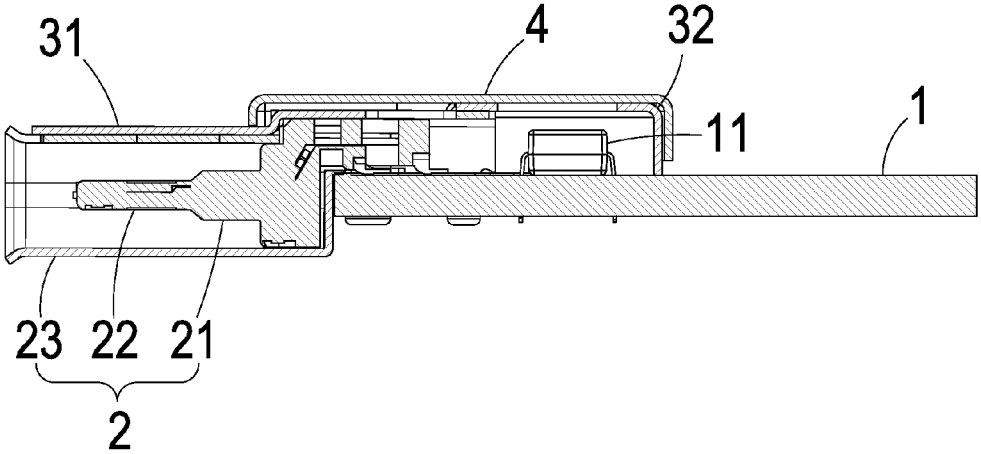
FIG. 2 is a sectional diagram showing the connector of FIG. 1 along A-A line of FIG. 1.
Figure 3:
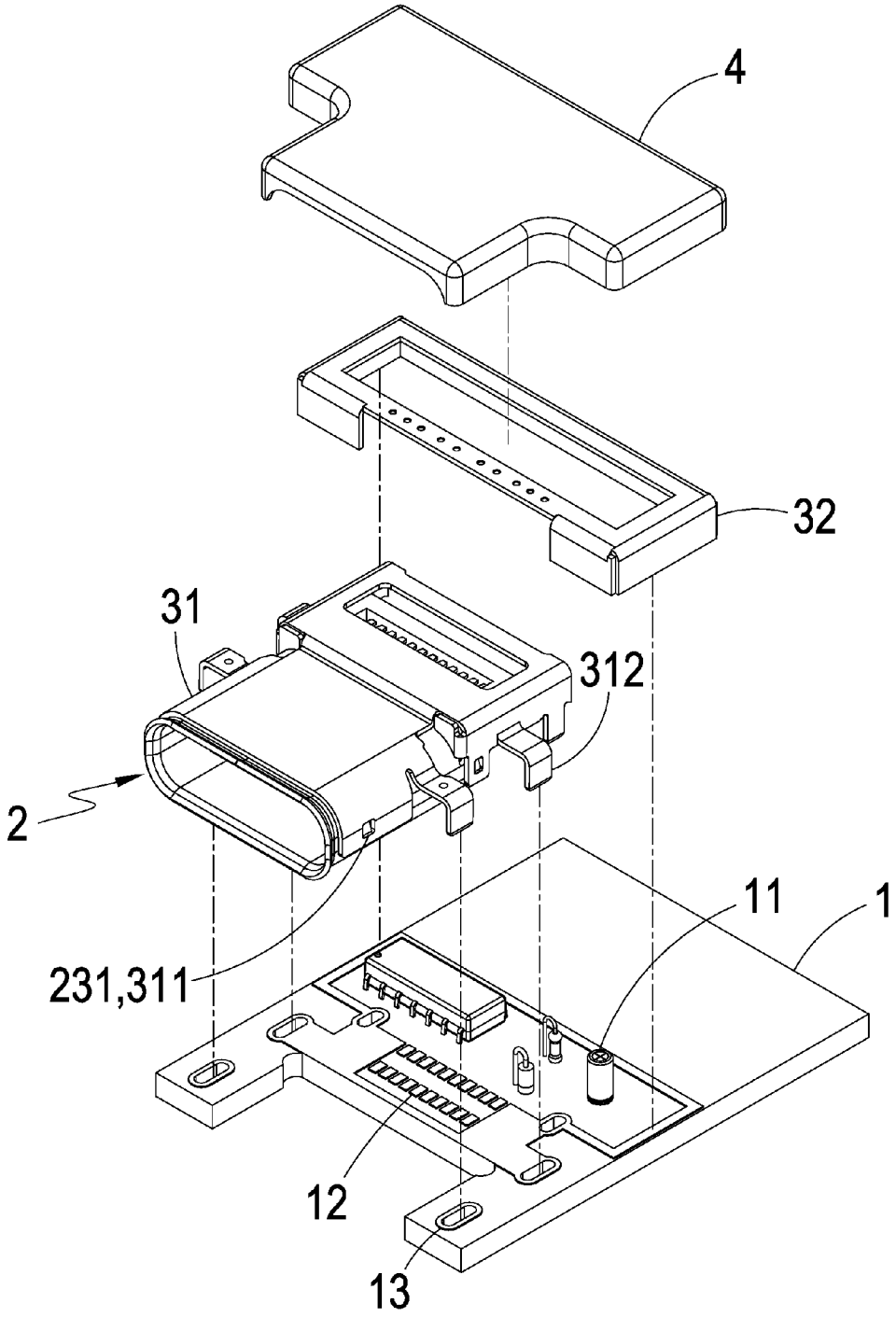
FIG. 3 is a perspective break-down diagram showing the connector of FIG. 1.

FIGS. 1 to 3 provide perspective, sectional, and break-down views to a connector according to a first embodiment of the present invention. As illustrated, the present invention teaches a connector including a circuit board 1, at least a transmission assembly 2, a first shielding member 31, a second shielding member 32, and a cover 4. The circuit board 1 has a number of electronic components 11, a number of transmission contacts 12 electrically connected to the electronic components 11, and at least a socket element 13. The transmission assembly 2 has a back section joined to a front section of the circuit board 1 and is located to a side of the electronic components. The transmission assembly 2 conforms to a connection standard. In the present embodiment, the transmission assembly 2 conforms to the Type-C University Serial Bus (USB) specification. The transmission assembly 2 includes a plastic insulating element 21, at least a set of transmission terminals 22 on the plastic insulating element 21, and a case element 23 surrounding the plastic insulating element 21. The set of transmission terminals 22 are aligned and connected to the transmission contacts 12 for data transmission. The case element 23 has at least a first fastening element 231.

The first shielding member 31 is disposed on the circuit board 1 and shields the transmission assembly 2. The first shielding member 31 includes at least a second fastening element 311 corresponding to a first fastening element 231 for mutual engagement. The first shielding member 31 further includes at least a plug element 312 corresponding to a socket element 13 for mutual engagement. The second shielding member 32 is disposed on the circuit board adjacent to the first shielding member 31, and shields the electronic components 11. The first and second shielding members 31 and 32 are tightly joined to the circuit board 1 by, for example, soldering. The cover 4 is disposed on and shields the first and second shielding members 31 and 32.

Figure 4:
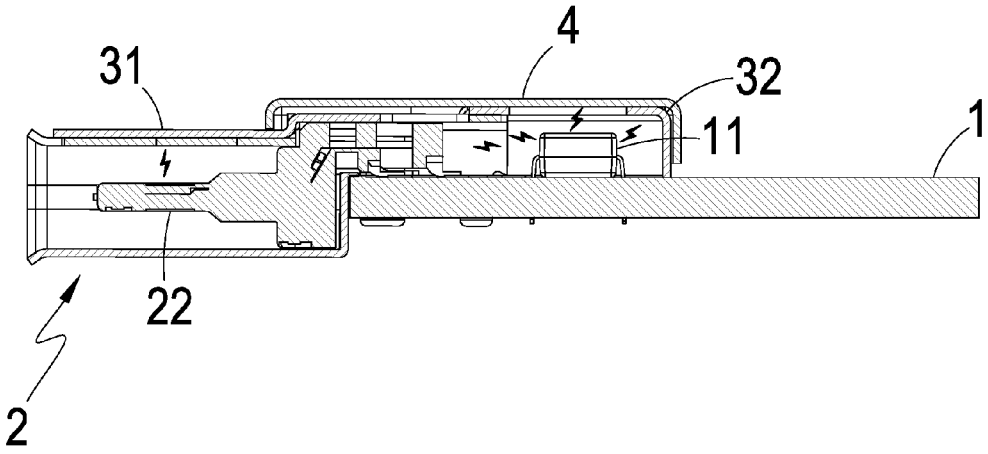
FIG. 4 is a sectional diagram showing the shielding effect of the connector of FIG. 1.

FIG. 4 depicts the shielding effect of the connector. As can be seen from FIGS. 1 to 4, to produce a connector of the present invention, the first and second shielding members 31 and 32 are manufactured separately. When manufacturing the shielding members 31 and 32, only the second shielding member 32 has to be varied to fit different requirements whereas the first shielding member 31 always conforms to an existing standard. Therefore the connector can be produced to meet different needs by using a common first shielding member 31 joined to a second shielding member 32 adapted to a specific requirement such as dimension, shape, etc. Therefore, production and stock costs can be reduced.

When the connector is connected to a corresponding connector (not shown), the transmission assembly 2 is conducted and signal communication is carried out through the transmission assembly 2 and the circuit board 1. In the communication process, the set of transmission terminals 22 and the electronic components 11 would produce RF signals. However, the transmission assembly 2 is shielded by the first shielding member 31, the electronic components 11 are shielded by the second shielding member 32. In addition, the first and second shielding members 31 and 32 are tightly joined to the circuit board 1, and they are further shielded by the cover 4. Due to the two layers' shielding and the tight joint, the RF signals are prevented from leakage, thereby enhancing transmission quality.

Figure 5:
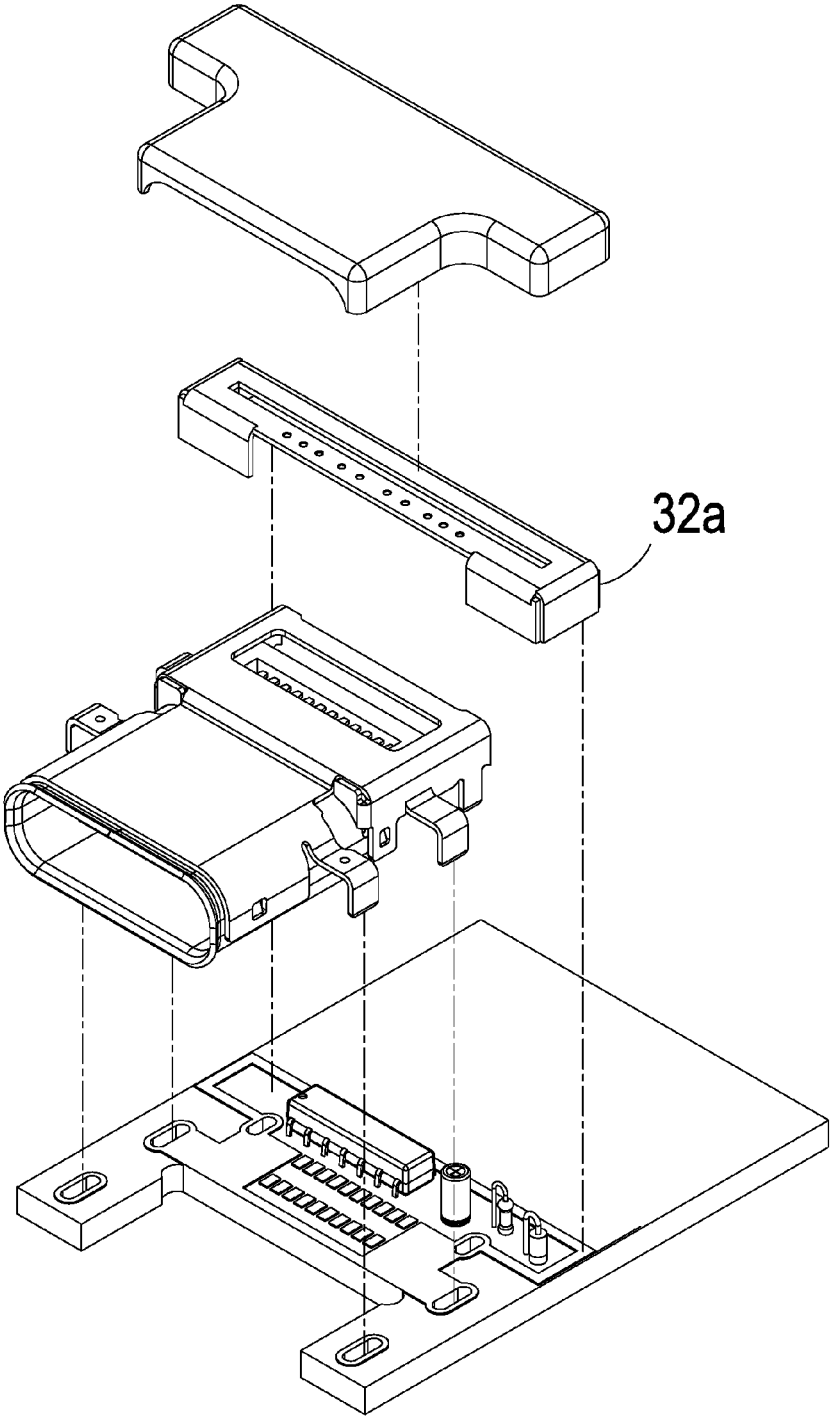
FIG. 5 is a perspective break-down diagram showing a connector according to a second embodiment of the present invention.

FIG. 5 provides a break-down diagram of a connector according to a second embodiment of the present invention. As illustrated, the second shielding member 32*a* has a different dimension from that of the second shielding member 32 of the previous embodiment. This demonstrate how a connector of the present invention adapts to different requirements.

Figure 6:
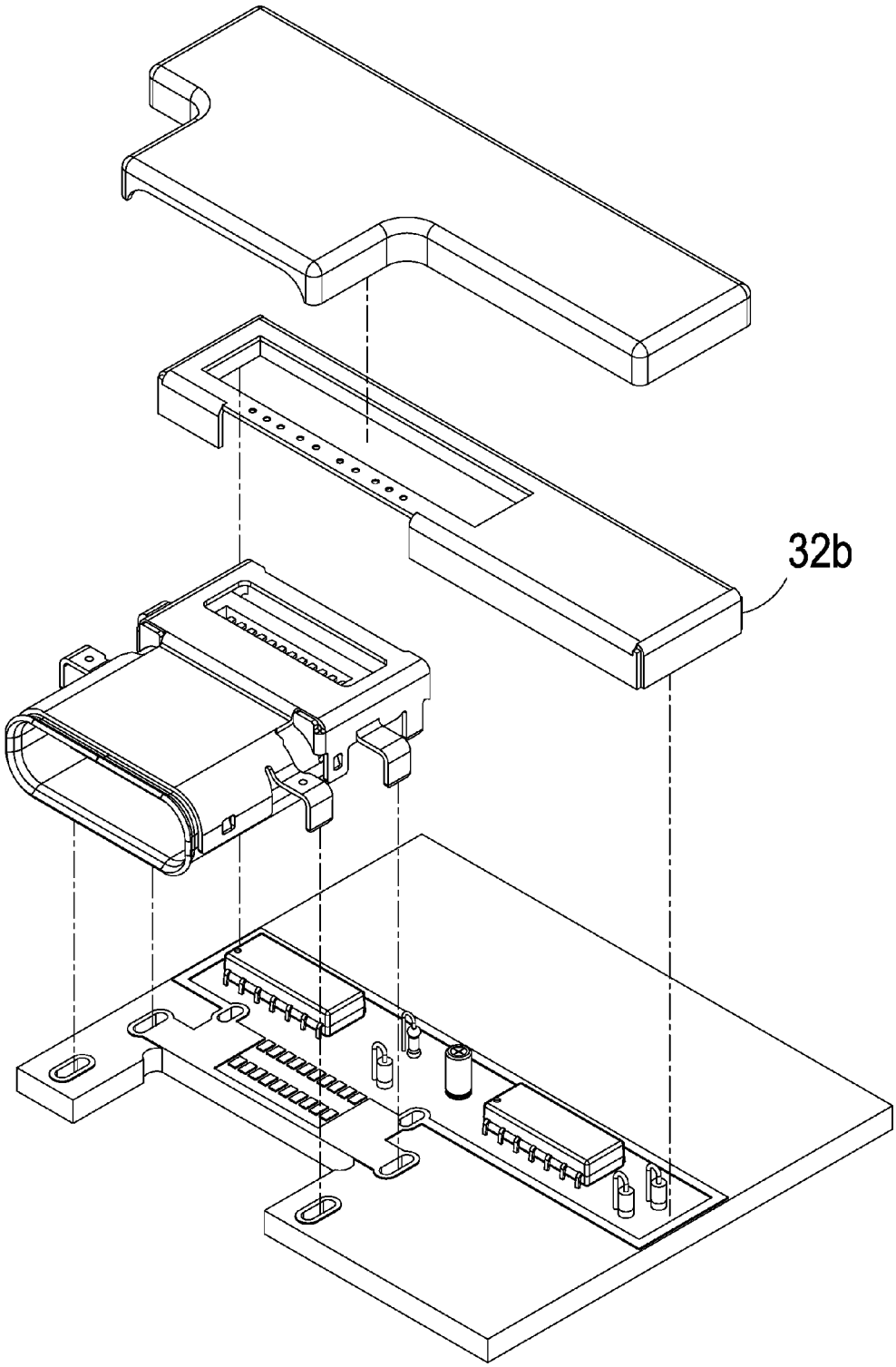
FIG. 6 is a perspective break-down diagram showing a connector according to a third embodiment of the present invention.

FIG. 6 provides a break-down diagram of a connector according to a third embodiment of the present invention. As illustrated, the second shielding member 32*b* again has a different dimension from those of the second shielding members 32 and 32*a* of the previous embodiments. This demonstrate how a connector of the present invention adapts to different requirements.

Therefore, compared to the prior art, the present invention provides the following advantages.

Firstly, the first shield member 31, the second shielding member 32, and the cover 4 jointly enhance the transmission quality.

Secondly, having separate first and second shielding members 31 and 32 contributes to the connector's production flexibility and low cost.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A connector, comprising a circuit board having a plurality of electronic components on a top side of the circuit board;

at least a transmission assembly having a first portion joined to the top side of the circuit board adjacent to the electronic components and a second portion extended laterally beyond the circuit board;

a first shielding member disposed on the circuit board having a first portion covering the entire first portion of the transmission assembly and a second portion completely surrounding the second portion of the transmission assembly;

a second shielding member disposed on the top side of the circuit board immediately adjacent to the first portion of the first shielding member covering all electronic components; and a cover disposed on the top side of the circuit board and covering the entire second shielding member and the first portion of the first shielding member.

2. The connector according to claim 1, wherein the transmission assembly comprises a plastic insulating element, at least a set of transmission terminals on the plastic insulating element, and a case element surrounding the plastic insulating element.

3. The connector according to claim 2, wherein the circuit board has a plurality of transmission contacts electrically connected to the electronic components; and the set of transmission terminals are aligned and connected to the transmission contacts for data transmission.

4. The connector according to claim 2, wherein the case element has at least a first fastening element; and the first shielding member has at least a second fastening element corresponding to one of the first fastening elements for mutual engagement.

5. The connector according to claim 1, wherein circuit board has at least a socket element; the first shielding member has at least a plug element corresponding to one of the socket elements for mutual engagement.

6. The connector according to claim 1, wherein the first and second shielding members are tightly joined to the circuit board by soldering.

* * * * *